US006723966B2

(12) United States Patent
Jiang

(10) Patent No.: US 6,723,966 B2
(45) Date of Patent: Apr. 20, 2004

(54) PTC HEATER

(75) Inventor: Guomo Jiang, Liaoning (CN)

(73) Assignee: Guangquan Zhang (CN)

( * ) Notice: Subject to any disclaimer, the term of this patent is extended or adjusted under 35 U.S.C. 154(b) by 212 days.

(21) Appl. No.: 10/074,029

(22) Filed: Feb. 14, 2002

(65) Prior Publication Data

US 2003/0015520 A1 Jan. 23, 2003

(30) Foreign Application Priority Data

Jul. 18, 2001 (CN) ..... 01248755 U

(51) Int. Cl.[7] ..... H05B 3/00
(52) U.S. Cl. ..... 219/505; 219/540
(58) Field of Search ..... 219/505, 538, 219/540, 542, 483, 485, 504; 156/252, 273.7, 273.9; 338/22 R, 51; 392/347, 360

(56) References Cited

U.S. PATENT DOCUMENTS 4,414,052 A * 11/1983 Habata et al. ..... 156/273.7
4,931,626 A * 6/1990 Shikama et al. ..... 219/540
5,057,672 A * 10/1991 Bohlender et al. ..... 219/540
5,471,034 A * 11/1995 Kawate et al. ..... 219/540
5,854,471 A * 12/1998 Tadokoro et al. ..... 219/540
5,995,711 A * 11/1999 Fukuoka et al. ..... 219/540
6,259,075 B1 * 7/2001 Wu ..... 219/540

* cited by examiner

*Primary Examiner*—Tu Ba Hoang
(74) *Attorney, Agent, or Firm*—Venable; James R. Burdett

(57) ABSTRACT

A PTC heater mainly comprises PTC ceramic sheets and cooling fins, and it comprises an inner support in which the PTC sheets are disposed, two electrode plates being disposed on both sides of the support and the PTC sheets to abut against the PTC sheets tightly, the cooling fins being disposed at the exterior of the electrode plates, insulating plates being mounted between the cooling fins and the electrode plate, in the interior of upper and lower ends of the two cooling fins, corresponding clamping grooves being formed through which the two cooling fins are clamped together, and elastic rods being inserted in the clamping grooves.

4 Claims, 2 Drawing Sheets

PTC HEATER

TECHNICAL FIELD

The invention relates to a heater using PTC (positive temperature coefficient) thermal ceramic resistor as the heating element.

BACKGROUND ART

PTC heater is developed rapidly in recent years. It has been applied in electric products such as air heater, drier, water heater, air conditioner and so on. The characteristics of it are automatic heat adjustment, rapid heating-up and small electrical pressure undulations. Traditional PTC heater assemblies are made of aluminium corrugation cooling fins stuck together by silica gel. The surface of the aluminium fins is usually electrified, so the aging of the silica gel and the lowering of its bonding ability would lead to instability and attenuation of the heating power of the heater assembly. Especially the heater has many hidden dangers in electric performance. The surface of cooling fins is electrified. In case of the drop off of the aluminium chips or other conductive medium, short or even a fire will happen. Because of the influence of creepage clearance, traditional products have a lot of restrictions in installation and use, in addition, they can not be operated in safety, spark and short often happen.

DISCLOSURE OF THE INVENTION

The object of the invention is to provide a PTC heater, which could keep the stability of power for a long time and its surface is not electrified.

To achieve above object, according to the invention, a PTC heater is provided, which mainly comprises PTC ceramic sheets and cooling fins, and is characterized by comprising an inner support in which the PTC sheets are disposed, two electrode plates being disposed on both sides of the support and the PTC sheets to abut against the PTC sheets tightly, the cooling fins being disposed at the exterior of the electrode plates, insulating plates being mounted between the cooling fins and the electrode plate, in the interior of upper and lower ends of the two cooling fins, corresponding clamping grooves being formed through which the two cooling fins are clamped together, and elastic rods being inserted in the clamping grooves.

Mechanical clamping method is adopted in this invention. The fitting structure of the elastic rod and the clamping grooves of cooling fins has taken the place of the traditional gluing structure, so the problem of aging of the silica gel and the lowering of power in traditional products is solved thoroughly. The PTC heater according to the invention is prevented from sparking and shorting and has a good safety and cooling performance. The surface of the heater is not electrified so that the heater has more safety. The heater has an original structure and good shape.

BRIEF DESCRIPTION OF THE DRAWINGS

A preferred embodiment of the invention will now be described by way of example and with reference to the accompanying drawings, in which.

EMBODIMENT OF THE INVENTION

Figure 1:
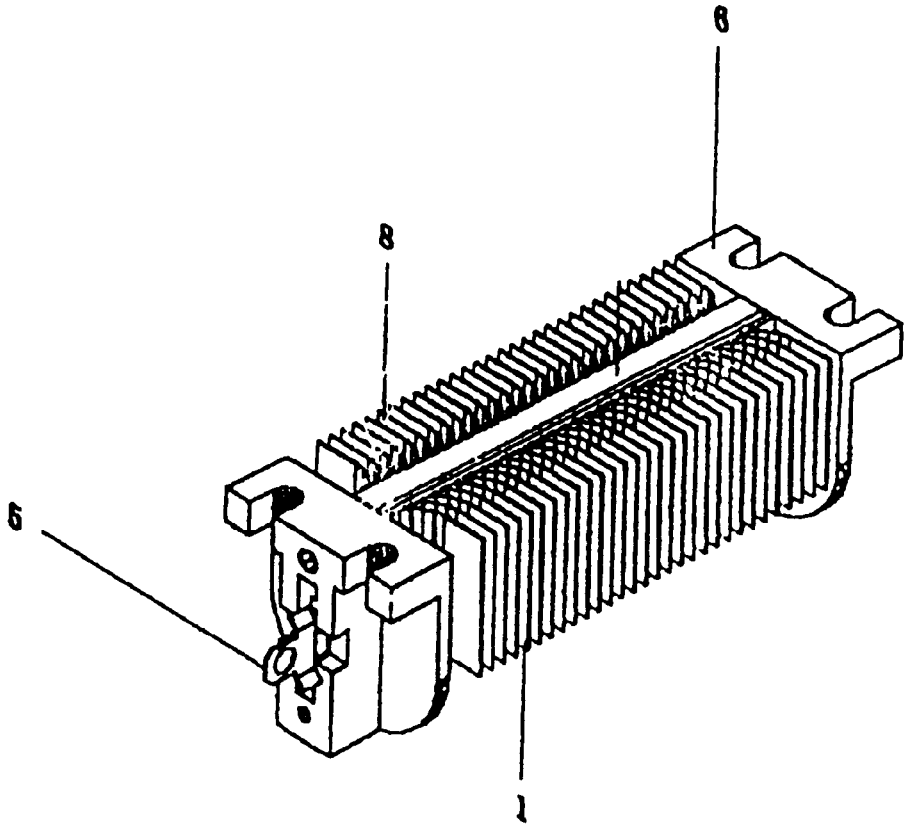
FIG. 1 is a schematic diagram of the PTC heater according to the invention.
Figure 2:
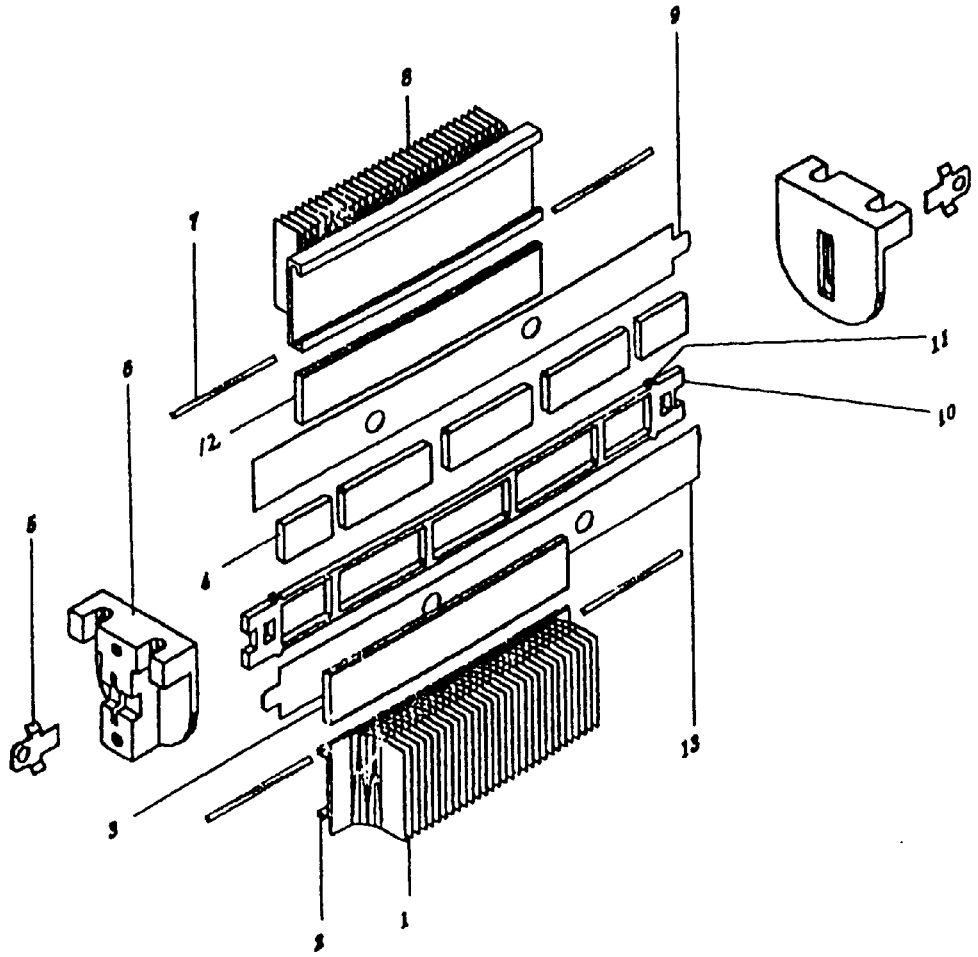
FIG. 2 is a schematic diagram of the assembly of the PTC heater according to the invention.

As shown in FIGS. 1 and 2, in the preferred embodiment, the corresponding openings shaped as the PTC sheets 4 are formed on the support 10. A plurality of PTC ceramic sheets 4 are placed in the openings on the support 10. Two electrode plates 9 and 13 are clamped on either side of PTC sheets 4 and the support 10, thus the PTC sheets 4 are in parallel connection. Cooling fins 1 and 8 are disposed on either outside of the two electrode plates 9 and 13 respectively. Insulation plates 3 and 12 are mounted between the cooling fins 1, 8 and the electrode plates 9, 13, thus the electrode plates are insulated from the cooling fins so that the surface of the cooling fins is not electrified. In the interior of upper and lower ends of the cooling fins 1 and 8, corresponding clamping grooves 2 are formed through which the two cooling fins 1 and 8 are connected together. A projection 11 is formed on the support 10 for restricting the position of the two cooling fins 1 and 8 and keeping them from moving back and forth. Several elastic rods 7 are fitted in the clamping grooves 2 of the two cooling fins 1 and 8 so as to connect the cooling fins together tightly. The elastic rods 7 are tapered so that the insertion length of the elastic rods in the clamping groove 2 is adjusted to control the clamping force continuously for guaranteeing that electrode plates 9 and 13 contact with the PTC sheets 4 well. The parts of the cooling fins exposed from both ends of the support 10 are covered by bracket 6 made of heat resisting plastic. The terminal 5 is connected with the electrode plates by spot welding or riveting to restrict the position of the bracket and to prevent the bracket 6 from moving back and forth. The support 10 is also formed of several connecting parts. In the preferred embodiment of the invention, the cooling fins 1 and 8 are ultra-thin fins produced by backing-off process. The cooling fins are characterized by small size, light weight, larger cooling area and improved cooling ability.

What is claimed is:

1. A PTC heater which mainly comprises PTC ceramic sheets and cooling fins, wherein it comprising an inner support (10) in which the PTC sheets (4) are disposed, two electrode plates (9, 13) being disposed on both sides of the support (10) and the PTC sheets (4) to abut against the PTC sheets (4) tightly, the cooling fins (1, 8) being disposed at the exterior of the electrode plates, insulating plates (3, 12) being mounted between the cooling fins and the electrode plates, in the interior of upper and lower ends of the cooling fins (1, 8), corresponding clamping grooves (2) being formed through which the cooling fins (1, 8) are clamped together, and elastic rods (7) being inserted in the clamping grooves (2).

2. A PTC heater as claimed in claim 1, wherein corresponding openings shaped as the PTC sheets (4) are formed on the support (10), the PTC sheets (4) are placed in the openings on the support (10).

3. A PTC heater as claimed in claim 1, wherein the support (10) is formed of several connecting parts.

4. A PTC heater as claimed in claim 1, wherein the cooling fins (1, 8) are ultra-thin cooling fins.

* * * * *